United States Patent [19]

Irazoqui et al.

[11] Patent Number: 4,869,133

[45] Date of Patent: Sep. 26, 1989

[54] DEVICE FOR REMOVING AND RETAINING CONTAMINATED STOPPERS

[75] Inventors: Carlos A. Irazoqui, New York; Terence Gibbs, Grandview, both of N.Y.

[73] Assignee: Novatek Medical Inc., New York, N.Y.

[21] Appl. No.: 210,938

[22] Filed: Jun. 24, 1988

[51] Int. Cl.[4] ..... B67B 7/02

[52] U.S. Cl. ..... 81/3.08; 81/3.36

[58] Field of Search ..... 81/3.07, 3.08, 3.2, 81/3.31, 3.09, 3.25, 3.36; 53/381 A, 381 R

[56] References Cited

U.S. PATENT DOCUMENTS

| | | | |
|---|---|---|---|
| 1,090,422 | 3/1914 | Stovall et al. . | |
| 1,511,522 | 10/1924 | Rolsky . | |
| 2,090,714 | 8/1937 | Wright et al. | 81/3.08 |
| 3,232,146 | 2/1966 | Behn . | |
| 4,067,473 | 1/1978 | Awer et al. . | |
| 4,217,798 | 8/1980 | McCarthy | 81/3.2 |
| 4,296,653 | 10/1981 | Lundgren et al. . | |
| 4,522,089 | 6/1985 | Alvi . | |
| 4,615,242 | 10/1986 | Milin . | |
| 4,704,924 | 11/1987 | Echols . | |
| 4,726,264 | 2/1988 | Bost . | |

FOREIGN PATENT DOCUMENTS

| | | |
|---|---|---|
| 2406005 | 8/1975 | Fed. Rep. of Germany . |
| 3047817 | 7/1982 | Fed. Rep. of Germany . |

*Primary Examiner*—Roscoe V. Parker

*Attorney, Agent, or Firm*—Gottlieb, Rackman & Reisman

[57] ABSTRACT

A device which not only removes the stopper from a test tube or vacutainer without any human contact, but one which also stores and retains the removed stoppers is disclosed. The device has a container for receiving and retaining the removed stoppers which communicates with a stopper extractor. The stopper extractor has one extractor lip which bears against a first side of the vacutainer and a second extractor lip which engages an opposite side of the stopper such that relative pivoting movement between them exerts a force on the stopper to urge it out of the vacutainer. A spring device is attached to the stopper extractor and has a leaf spring which contacts one side of the vacutainer after it has been inserted into the stopper extractor. During pivoting movement between the stopper extractor and the test tube or vacutainer, the leaf spring is further displaced from its normal, at-rest position. Once the stopper has been removed from the test tube, the leaf spring snaps back into its normal position, thereby exerting a force on the removed stopper urging it into the container.

13 Claims, 3 Drawing Sheets

FIG. 1
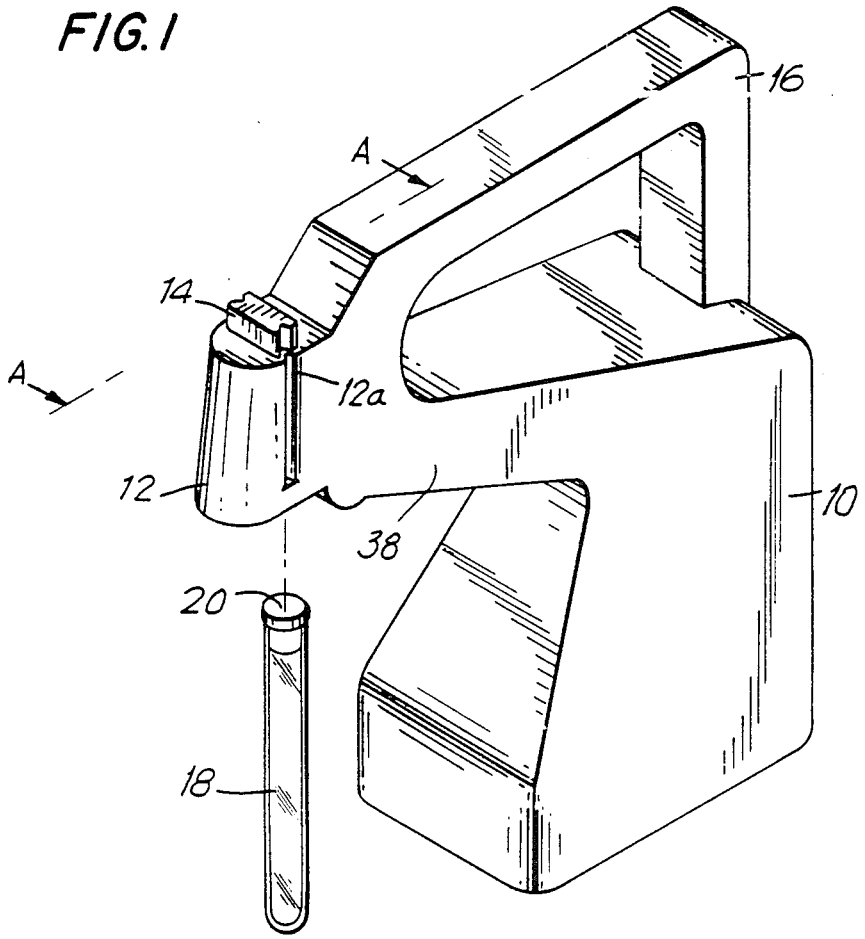
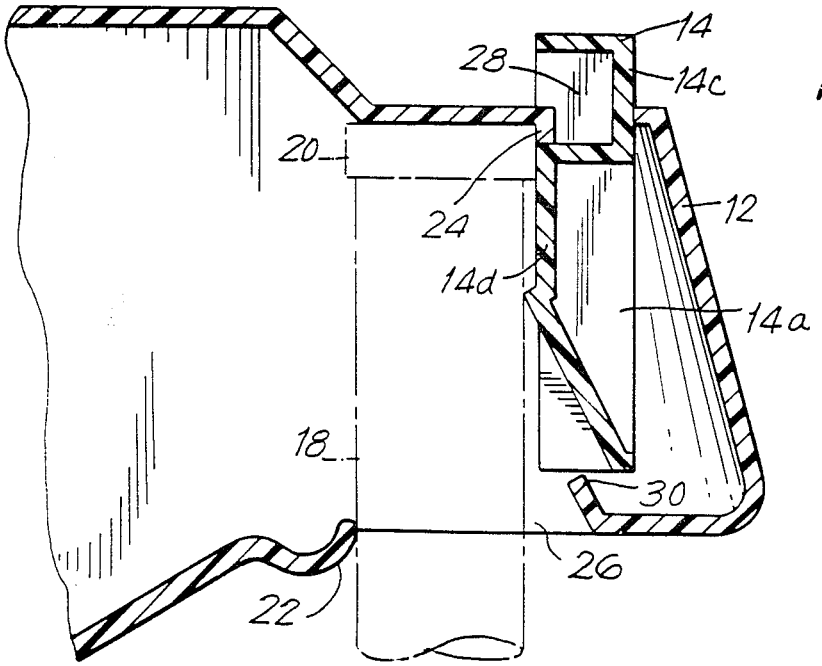
FIG. 2

FIG. 3
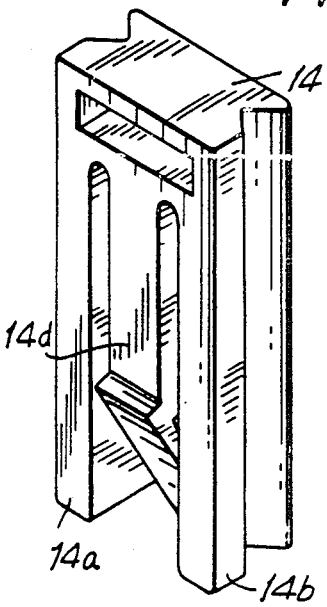
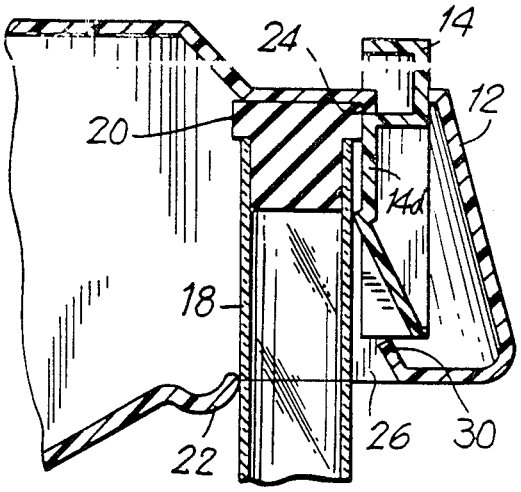
FIG. 4
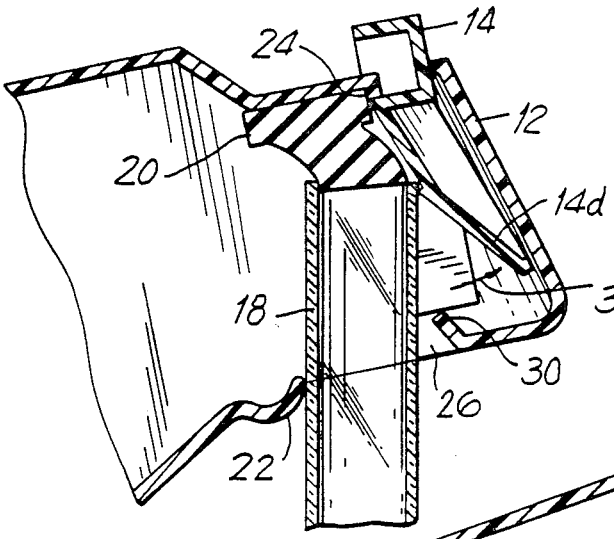
FIG. 5
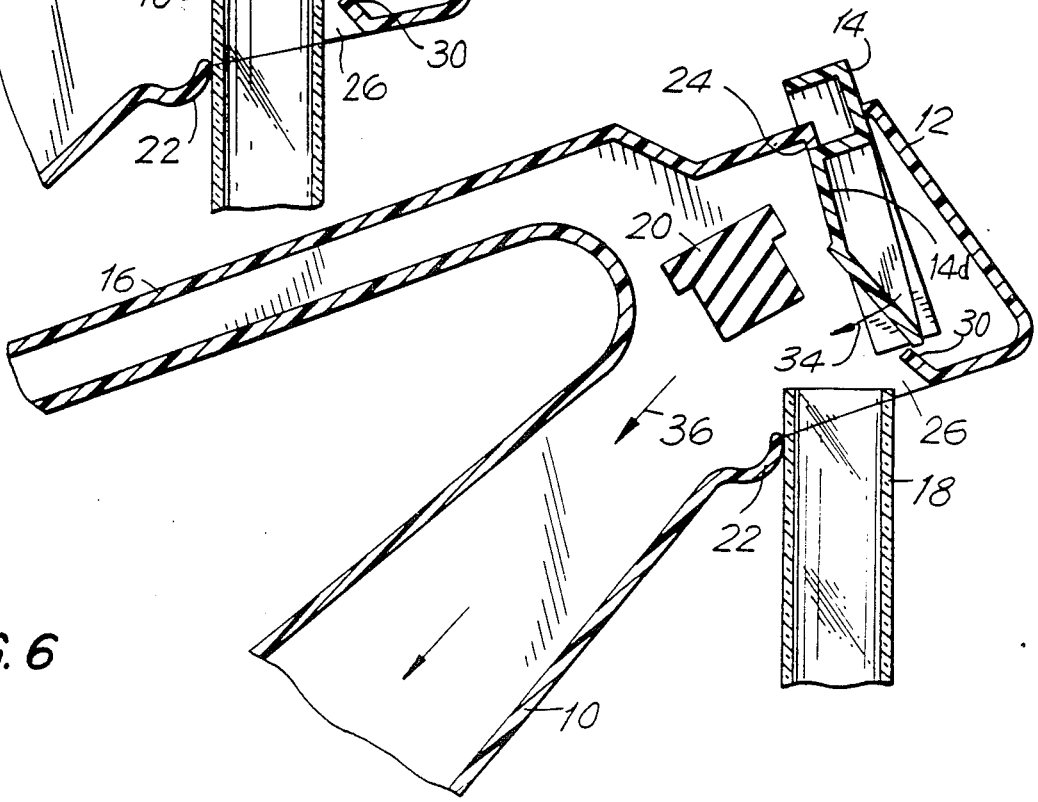
FIG. 6

DEVICE FOR REMOVING AND RETAINING CONTAMINATED STOPPERS

BACKGROUND OF THE INVENTION

The present invention relates to a device for removing and retaining stoppers from a test tube or the like, more particularly such a device which enables the removal and storage of such stoppers without direct human contact.

To obtain a blood specimen from a patient, most hospitals or doctors' offices use a double-pointed needle, one end of which is inserted into the patient's vein, while the other end is inserted through a rubber stopper of a glass test tube commonly called a vacutainer. The rubber stopper is inserted into the test tube or vacutainer inside a vacuum chamber such that the interior of the vacutainer or test tube has a pressure lower than the ambient atmosphere. The rubber stopper has an upper part comprising a relatively thin rubber membrane that is thick enough to preserve the vacuum, but thin enough to be easily penetrated by the second side of the double-pointed needle. Once the second needle penetrates the stopper, the blood from the patient's vein will flow through the two needles and into the vacutainer.

Once a sufficient amount has been withdrawn, the vacutainer is removed from the second needle and usually forwarded to a laboratory wherein the tests on the blood are conducted. When the specimen containing vacutainers reach the laboratory, they are typically placed on a test tube rack and the stoppers removed by manually twisting them off, usually utilizing three fingers. Usually the amount of blood withdrawn from the patient is sufficient to contact the inner portion of the stopper during transportation of the vacutainer from the patient to the laboratory. Thus, there is a danger that the laboratory technician will come into contact with the blood sample during removal of the stopper from the vacutainer. Quite obviously, the blood may contain highly contagious and infectious viruses and any contact therewith should be avoided.

Various devices have been proposed to avoid direct physical contact when removing stopper from vacutainers or test tubes or the like. Generally, these devices comprise a rubber sleeve or some such similar structure which fits over the end of the test tube and enables the laboratory technician to grasp the stopper with the sleeve in order to remove it. However, these devices have not proven to be a complete solution to the problem, since the stopper must be subsequently removed from the rubber sleeve so that it may be disposed of. Again, this removal presents the opportunity for physical contact between the laboratory technician and the contaminated stopper. Other devices have been proposed, but none have resolved the problem of storing and disposing of the stopper once it has been removed from the test tube.

SUMMARY OF THE INVENTION

The present invention relates to a device which not only removes the stopper from a test tube or vacutainer without any human contact, but one which also stores and retains the removed stoppers. The device has a container for receiving and retaining the removed stoppers which communicates with a stopper extractor. The stopper extractor has one extractor lip which bears against a first side of the vacutainer and a second extractor lip which engages an opposite side of the stopper such that relative pivoting movement between them exerts a force on the stopper to urge it out of the vacutainer.

A spring device is attached to the stopper extractor and has a leaf spring which contacts one side of the vacutainer after it has been inserted into the stopper extractor. During pivoting movement between the stopper extractor and the test tube or vacutainer, the leaf spring is displaced from its normal, at-rest position. Once the stopper has been removed from the test tube, the leaf spring snaps back toward its normal position, thereby exerting a force on the removed stopper urging it into the container.

The container is completely sealed except for an opening which communicates with the stopper extractor. This prevents any possibility of any inadvertent contact between the user and the removed stoppers. Once the container is full, the entire device is disposed of in accordance with accepted guidelines for disposing of contaminated articles.

BRIEF DESCRIPTION OF THE DRAWINGS

FIG. 1 is a perspective view of the device according to the invention.

FIG. 2 is a partial cross-sectional view taken along line A—A in FIG. 1.

FIG. 3 is a perspective view of the spring device associated with the stopper extractor according to the invention.

FIGS. 4, 5, and 6 are partial cross-sectional views, similar to FIG. 2, showing the removal sequence of the stopper.

DETAILED DESCRIPTION OF THE PREFERRED EMBODIMENT

Figure 7:
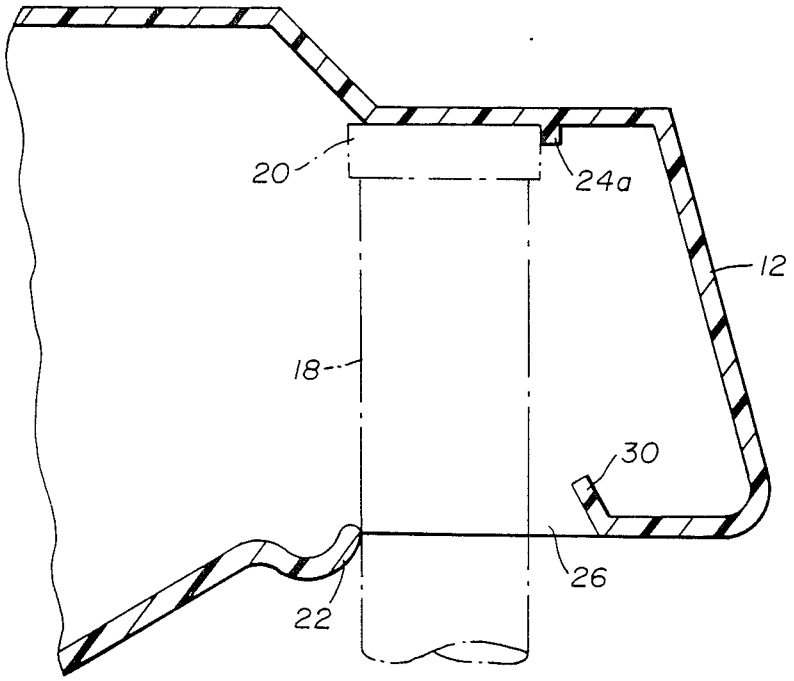
FIG. 7 is a partial cross-sectional view similar to FIG. 2 showing an alternative embodiment of the invention.

The device for removing and retaining contaminated stoppers according to the invention is illustrated in FIG. 1 and generally comprises a container 10 having a stopper extractor 12 associated therewith. A spring 14 is associated with the stopper extractor 12 in order to exert a force on the removed stoppers urging them into the container 10. Handle 16 may be associated with the container 10 in order to facilitate the relative pivoting movement between the extractor 12, the test tube or vacutainer 18 necessary to remove the stopper 20 therefrom.

The stopper extractor is shown in more detail in FIG. 2 and comprises a first extractor lip 22 and a second extractor lip 24. Stopper extractor 12 also defines an opening 26 of sufficient size to accommodate one end of vacutainer 18 and stopper 20. Extractor 12 is of sufficient size such that it may completely envelope the upper end of test tube 18 including stopper 20.

Extractor 12 also defines an upper opening 28 designed to accommodate the spring 14. As illustrated in FIGS. 2 and 3, spring 14 generally comprises a "U" shaped mounting frame having legs **14*a* and 14*b* and a cross member 14*c*. Each of the legs 14*a* and 14*b* has a generally longitudinally extending recess which engages a corresponding protrusion formed in opposite sides of extractor 12 and illustrated in FIG. 1 at 12*a*. The interengagement of the protrusions and grooves serves to positively locate the spring 14 in extractor 12. The spring 14 is inserted downwardly through opening 28 until the upper end of leaf spring member 14*d* snaps over the lower edge portion of extractor lip 24, as illustrated in FIG. 2. Downward movement of the spring 14 is prevented by contact with locating lip 30 formed on the extractor 12**.

The removal sequence is illustrated in FIGS. 4, 5 and 6. As can be seen, handle 16 is grasped by the user in one hand and vacutainer 18 is inserted into the opening 26 in the stopper extractor 12 while being held in the user's other hand. The vacutainer 18 is inserted to the position shown in FIG. 4 such that extractor lip 22 bears against one side of the vacutainer, while extractor lip 24 bears against the opposite side of the stopper 20. In this position, the lateral ridge formed on spring **14*d* bears against the opposite side of the vacutainer 18**.

As illustrated in FIG. 5, the extractor 12 is pivoted relative to the vacutainer 18 such that second extractor lip 24 exerts a force on stopper 20 urging it out of the vacutainer 18. During this relative pivoting movement between the device and the vacutainer 18, spring member **14*d* is displaced from its normal, at rest position, illustrated in FIG. 4, in the direction of arrow 32 in FIG. 5**.

Continued pivoting movement will remove the stopper 20 from the vacutainer 18 and, once the vacutainer 18 is moved downwardly, as illustrated in FIG. 6, out of contact with the ridge formed in spring 14d, the spring snaps back in the direction of arrow 34 contacting the removed stopper 20 and exerting a force against it, urging it in the direction of arrows 36 into the container 10. This prevents the removed stopper from accidentally falling through opening 26 and coming into contact with the user.

When the stopper is removed, minute particles of blood may be dispersed into the air in an aerosol effect. Since extractor 12 completely envelopes the upper end of vacutainer 18 and the stopper 20, any contact between the user and the blood particle aerosol is prevented.

Extractor lip 22, as illustrated in FIGS. 2 and 4–6, is formed with a curved, concave cross-section to define a trough adjacent to the opening 26. Any excess blood on the removed stopper 20 or on the open end of vacutainer 18 will drip into the trough and will be prevented from passing out through opening 26. The blood in the trough will pass into the container 10 as it is tilted (see FIG. 6).

The container 10, which may be molded as a unitary construction including the stopper extractor 12 and the handle 16, has only one opening which communicates with the extractor 12 by neck portion 38. The neck portion 38 may be wider at its attachment point to the container 10 than its attachment with the extractor 12 to facilitate passage of the stoppers from the extractor into the container. It is envisioned that the container, the extractor and the handle will be molded as a single element from a plastic material, such as polyethylene. The spring may also be formed of a plastic material in order to minimize the costs of the device. Once the container 10 has been filled with removed stoppers, the entire device may be disposed of within accepted guidelines for disposing of contaminated objects.

Although use of spring 14 is preferred, it is envisioned that the device according to the invention may be used without the spring. As shown in FIG. 7, the extractor lip **24*a* may be formed on an interior wall of extractor 12 to fulfill the same function as extractor lip 24 previously described. The operation of this alternative embodiment is exactly the same as the previously described embodiment, except that removed stopper 20 is caused to enter container 10 by the effect of gravity rather than the force of spring 14**.

The foregoing description is provided for illustrative purposes only and should not be construed as in any way limiting this invention, the scope of which is defined solely by the appended claims.

What is claimed is:

1. A device for removing and retaining a stopper from a test tube or the like without direct human contact with the stopper comprising:

(a) a container for receiving and retaining removed stoppers;

(b) stopper extractor means operatively associated with the container to remove the stopper from the test tube, said extractor means comprising first means for bearing against a first side of the test tube and second means for engaging a side of the stopper opposite the first side of the test tube, wherein said bearing means and said engaging means may simultaneously pivotally rotate so as to exert a force on said stopper for urging said stopper out of said test tube or the like; and (c) means operatively associated with the stopper extractor means for exerting a force on the removed stopper to urge the removed stopper toward the container.

2. The device according to claim 1 further comprising handle means associated with the container to facilitate manual manipulation of the container.

3. The device according to claim 1, wherein said first bearing means comprises a first extractor lip and wherein said second engaging means comprises a second extractor lip.

4. The device according to claim 3 wherein the first extractor lip defines a trough to retain excess liquid which may drip from the stopper or the test tube.

5. The device according to claim 1 wherein the force exerting means comprises spring means mounted on the stopper extractor means.

6. The device according to claim 5 wherein the spring means comprises a leaf-type spring.

7. The device according to claim 5 wherein the spring means comprises:

(a) a mounting frame attached to the stopper extractor means; and, (b) a leaf spring attached to the mounting frame.

8. The device according to claim 7 wherein the mounting frame has a substantially "U" shape wherein the leaf spring extends between the legs of the "U".

9. The device according to claim 1 wherein the container is completely sealed except for an opening communicating with the stopper extractor means.

10. A disposable device for removing and retaining a stopper from a test tube or the like comprising:

(a) a container having a single opening for receiving and retaining removed stoppers;

(b) stopper extractor means operatively associated with the container and communicating with the single opening to remove the stopper from the test tube, the stoppr extractor means having (i) a first extractor lip adapted to bear against a first side of the test tube, the first extractor lip having a concave cross-section to define a trough to retain excess liquid which may drip from the stopper or the test tube; and (ii) a second extractor lip adapted to engage a side of the stopper opposite the first side of the test tube such that relative pivoting movement between the stopper extractor means an the test tube exerts a force on the stopper urging it out of the test tube;

(c) a mounting frame having a generally "U" shape attached to the stopper extractor means; and, (d) a leaf-type spring attached to the mounting frame and located such that relative pivoting movement between the stopper extractor means and the test tube displaces the spring from its normal, at rest position such that, when the stopper is removed from the test tube, the spring snaps back toward its at rest position thereby exerting a force on the removed stopper urging it toward the opening in the container.

11. a device for removing and retaining a stopper from a test tube or the like without direct human contact with the stopper, comprising:

(a) a container for receiving and retaining removed stoppers; and (b) a stopper extractor means operatively associated with the container for removing the stopper from the test tube such that the removed stopper passes into the container, the extractor means comprising:

(i) a first extractor lip adapted to bear against a first side of the test tube; and (ii) a second extractor lip adapted to engage a side of the stopper opposite the first side of the test tube, wherein said first extractor lip and said second extractor lip may simultaneously pivotally rotate in order to exert a force on the stopper for urging it out of the test tube.

12. The device according to claim 11 wherein the first extractor lip defines a trough to retain excess liquid which may drip from the stopper or the test tube.

13. The device according to claim 11 wherein the container is completely sealed except for an opening communicating with the extractor means.

* * * * *